US005651326A

United States Patent [19]

Rice

[11] Patent Number: 5,651,326

[45] Date of Patent: Jul. 29, 1997

[54] DEVICE FOR PROTECTING THE HULL OF A WATER VEHICLE

[75] Inventor: Richard R. Rice, Old Hickory, Tenn.

[73] Assignee: Ricaha Corporation, Mt. Juliet, Tenn.

[21] Appl. No.: 602,235

[22] Filed: Feb. 15, 1996

[51] Int. Cl.[6] ..... B63C 1/02

[52] U.S. Cl. ..... 114/45; 114/222

[58] Field of Search ..... 114/261, 263, 114/222, 45, 47, 48, 266, 267; 405/63, 64, 68

[56] References Cited

U.S. PATENT DOCUMENTS

| | | | |
|---|---|---|---|
| 3,205,851 | 9/1965 | Wiswell, Jr. | 114/222 |
| 3,685,477 | 8/1972 | Wood | 114/222 |
| 4,339,215 | 7/1982 | Sluys | 114/263 |
| 5,138,963 | 8/1992 | Eichert | 114/222 |
| 5,465,676 | 11/1995 | Falcaro | 114/222 |

*Primary Examiner*—Edwin L. Swinehart
*Attorney, Agent, or Firm*—Waddey & Patterson; Edward D. Lanquist, Jr.

[57] ABSTRACT

The present invention discloses a device for protecting the hull of a water vehicle. The device has a frame having an opened end and a closed end. The frame has a right yoke and a left yoke which are preferably mirror images of one another and attach to one another preferably releasibly proximal to closed end. A sheet attaches to holes placed in the left and right yoke which form a bottom to the device with the right and left yokes being the sides. A tongue can also be provided as well as an anchoring device. Additionally, an extender can be provided to make the closed end broader to accommodate a larger craft.

8 Claims, 5 Drawing Sheets

DEVICE FOR PROTECTING THE HULL OF A WATER VEHICLE

BACKGROUND OF THE INVENTION

The present invention relates generally to water sports and more particularly to a device for protecting the hull of a water vehicle such as a boat or a jet ski from being scratched.

It will be appreciated by those skilled in the art that water sports are very popular. These water sports can consist of any type of water vehicle such as a bass or ski boat, a sailboat, a water ski, and the like. Often times, individuals desire to bring their water vehicles up to and onto a shore. The reason behind this is that not all shores have docks. Bringing a water vehicle onto a shore can often cause scratching to the hull. Over time, the scratching becomes not only unsightly but also aerodynamically unsound thereby causing the need for the hull to be repaired.

Devices such as those described in U.S. Pat. Nos. 4,260,282; 5,316,409; 4,972,791; 4,696,250; and 4,803,942 describe various types of portable docks. Unfortunately, before the water vehicle arrives into one of these portable docks, it can contact stones and other obstructions thereby causing scratching of the hull.

U.S. Pat. No. 4,962,719 discloses a bra that protects the hull of a boat. Unfortunately, this device is intended for only use with a bass boat and can not be easily used in connection with a sailboat or a jet ski. Further, this device is difficult to attach and remove. When it is left in the water, it is subject to dryrot or other type of damage. However, its inconvenience will cause individuals to keep the bra on the vehicle thereby causing rotting.

What is needed, then, is a device which can protect the hull of a water vehicle. This needed device must not be attached to a boat which would make it difficult to attach and remove from a boat and which would also affect the aerodynamics of the water craft during usage. This needed device must be easy to manufacture. This needed device must be capable of being disassembled into a very small unit. This needed device must be capable of being anchored to the shore. This needed device must be easily manufactured. This needed device is presently lacking in the prior art.

SUMMARY OF THE INVENTION

The present invention discloses a device for protecting the hull of a water vehicle. The device has a frame having an opened end and a closed end. The frame has a right yoke and a left yoke which are preferably mirror images of one another and attach to one another preferably releasibly proximal to closed end. A sheet attaches to holes placed in the left and right yoke which form a bottom to the device with the right and left yokes being the sides. A tongue can also be provided as well as an anchoring device. Additionally, an extender can be provided to make the closed end broader to accommodate a larger craft.

Accordingly, one object of the present invention is to provide a device which can protect the hull of a water vehicle from scratching.

Another object of the present invention is to provide a device which can be easily collapsed into a carryable piece.

A still further object of the present invention is to provide a device which is light weight.

A still further object of the present invention is to provide a device which can be easily and economically manufactured.

A still further object of the present invention is to provide a device which can be anchored to the shore.

Another object of the present invention is to provide a device which can be extended to receive a motor boat.

DESCRIPTION OF THE PREFERRED EMBODIMENT

Figure 1:
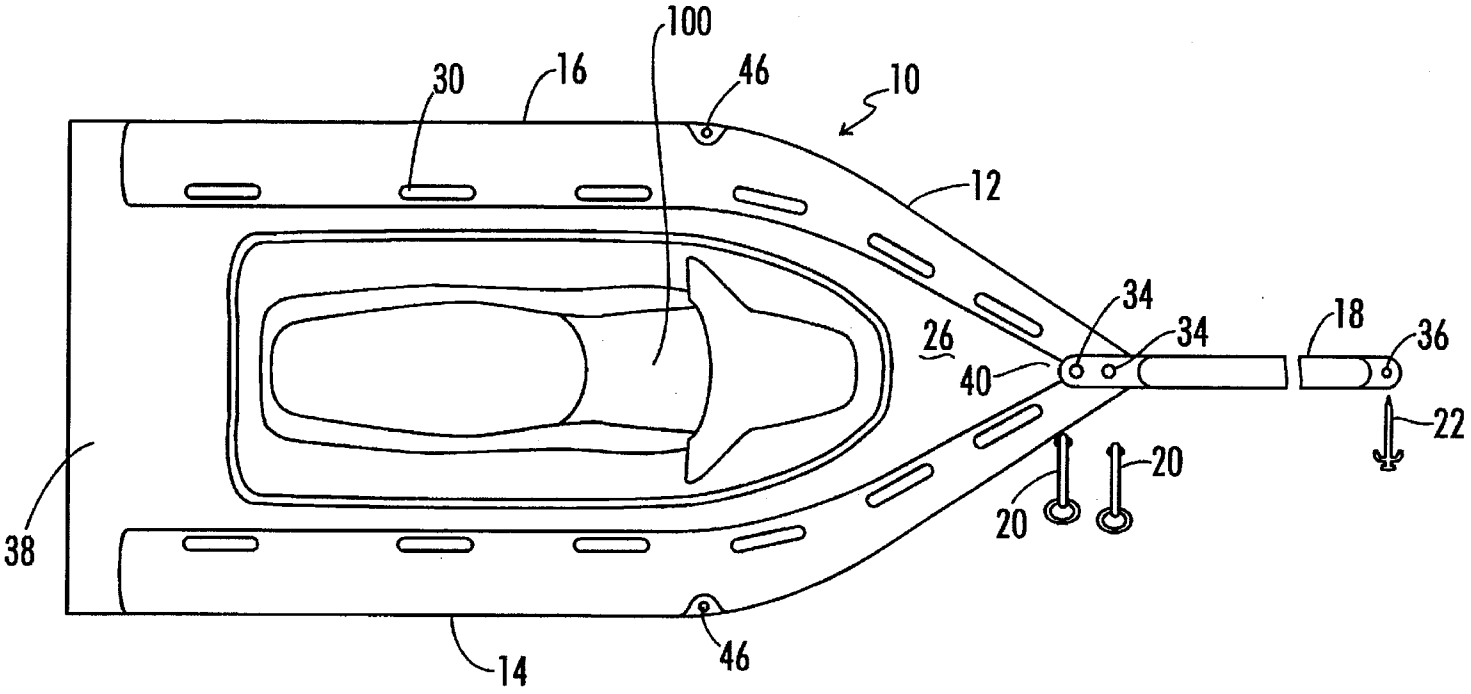
FIG. 1 is a plan view of the device of the present invention.
Figure 2:
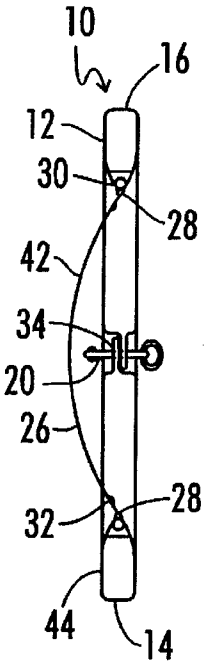
FIG. 2 is an end view of the device of the present invention.
Figure 3:
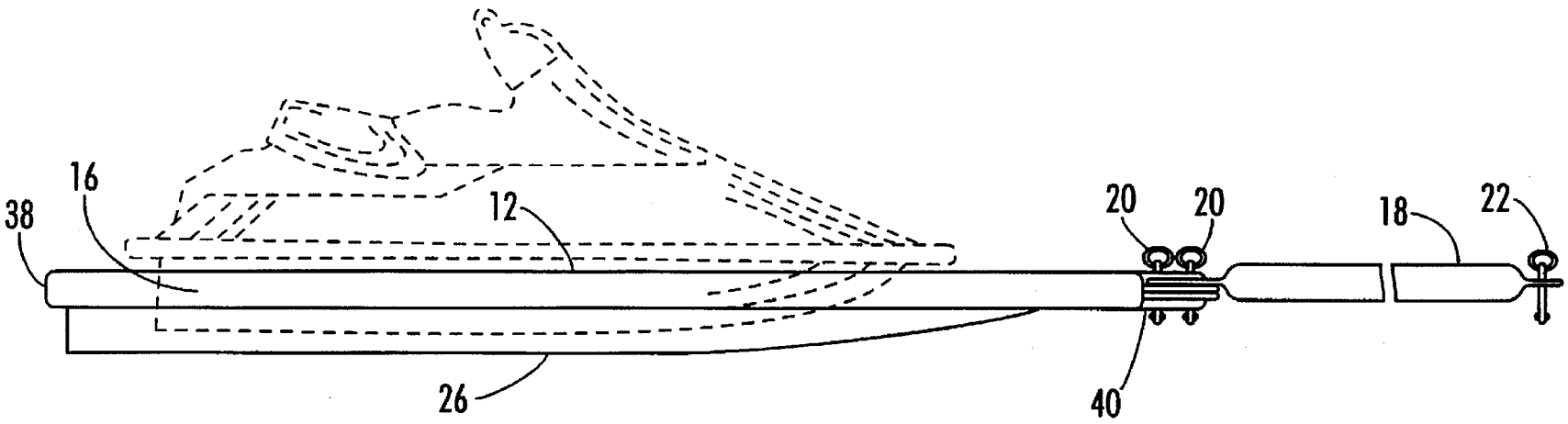
FIG. 3 is a side view of the device of the present invention.

Referring now to FIGS. 1–3, there is shown generally at 10 the device for protecting the hull of a water vehicle of the present invention. In the view shown in FIG. 1, water vehicle 10 is a standard jet ski. Device 10 has frame 12. Frame 12 has right yoke 14 and left yoke 16 having holes 34 which are attached together by pins 20. In the preferred embodiment, right yoke 14 and left yoke 16 are molded using the same mold and are therefore mirror images of one another thereby allowing easy mass production and easy replacement. Device 10 has opened end 38 and closed end 40. Water vehicle 100 is received by opened end 38 and directed into closed end 40. Pins 20 attach to holes 34 proximal closed end 40. Also attached by pins 20 through holes 34 there can be placed tongue 18 which extends frame 12 forwardly. Tongue 18 also has orifice 36 which can releasable receive anchor pin 26. Anchor 26 can be placed through orifice 36 and forced into the shore to keep device 10 stationery.

Yokes 14, 16, as seen in FIG. 2, have general angular tear shapes 44. Yokes 14, 16 have slots 30 into which tabs 28 of sheet 26 is placed. Sheet 26 attaches to frame 26 using snaps 32 on tabs 28 in the preferred embodiment. However, any releasible attachment can be used. Opening 46 is provided in each yoke 14, 16 to enable yokes 14, 16 to be placed on top of each other and pinned into place using pins 20. This enables device 10 be easily moveable.

In the preferred embodiment, yokes 14, 16, extender 24, and tongue 18 are molded from any type of plastic or can be manufactured from fiberglass. In the preferred embodiment, yokes 14, 16, extender 24, and tongue 18 are blow molded but can also be injection molded. In the preferred embodiment, sheet 26 is made of a nylon or any other kind of resilient flexible fabric.

Figure 4:
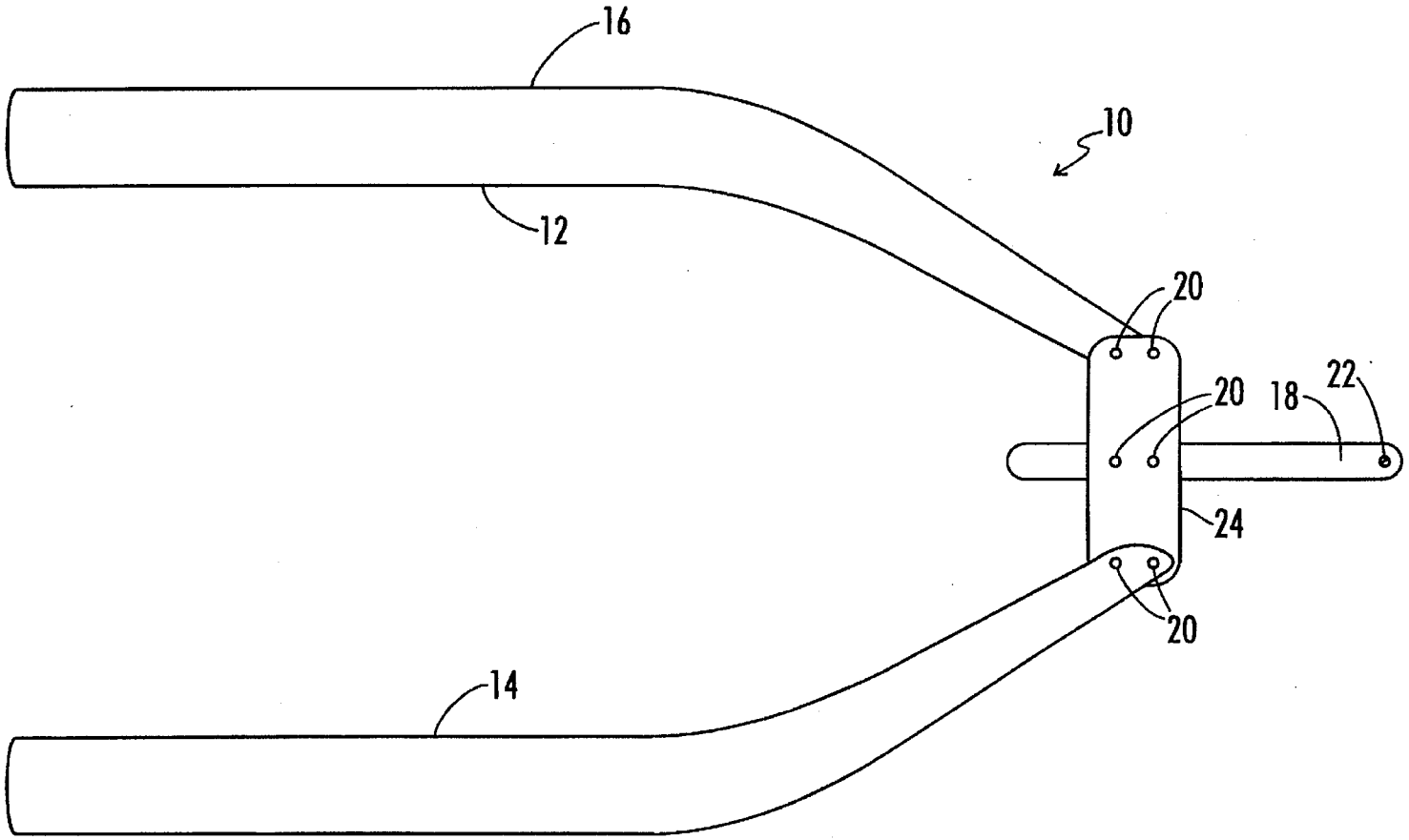
FIG. 4 is a plan view of the device of the present invention showing the extender.

Referring now to FIG. 4 there is shown generally at 10 another embodiment of the present invention. In this particular embodiment, extender 24 is provided to separate right yoke 14 from left yoke 16 thereby allowing a larger vehicle to be received by device 10. As can be seen, pins 20 attach left yoke 16 to extender 24 while separate pins attach right yoke 14 to extender 24. Two other pins are used to attach tongue 18 to extender 24.

Figure 5A:
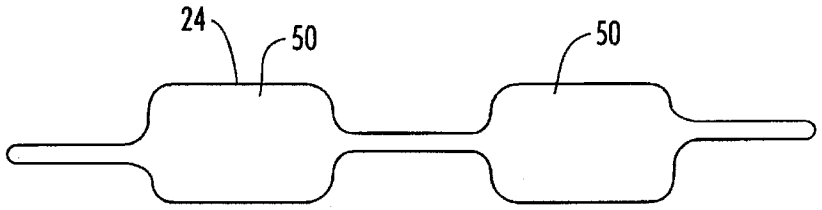
FIGS. 5*a* and 5*b* are views of the extender.
Figure 5B:
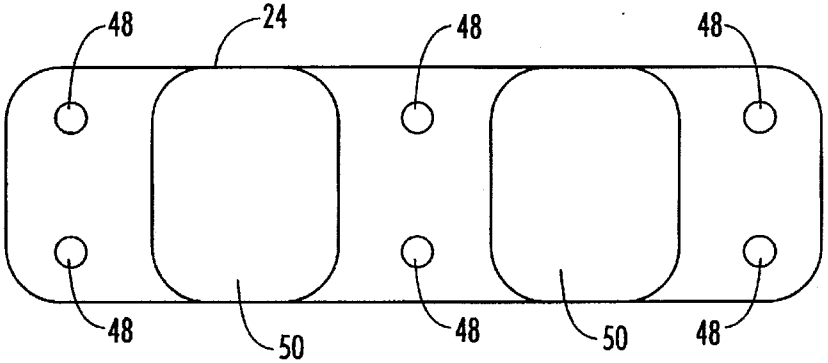

FIGS. 5*a* and 5*b* show extender 24 in greater detail. Extender 24 has bores 48 which receive pins (20 in FIG. 4).

Knobs 50 are provided to better segregate yoke 14, 16 and tongue 18 and to provided additional strength to extender 24.

Figure 6:
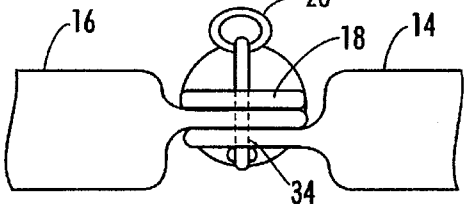
FIG. 6 is a cut-away view showing the attachment of the right yoke to the left yoke and the tongue.

Referring now to FIG. 6 there is shown how right yoke 14, left yoke 16, and tongue 18 are joined together. As can be seen, hole 34 runs through each of yokes 14, 16 and tongue 18 while pin 20 is placed through hole 34.

Preferably bottom 42 is in the shape of a partial bag and can have a seam down the middle which draws the sides together.

Figure 7A:
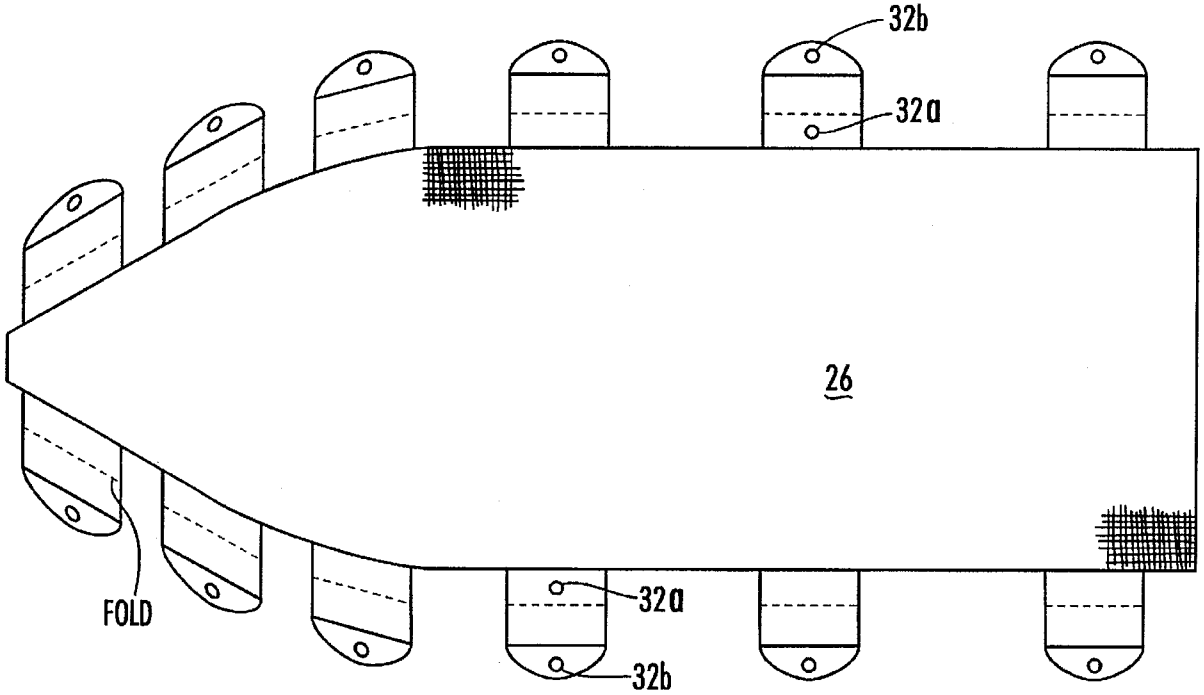
FIGS. 7*a* and 7*b* are views of the sheet of the present invention.
Figure 7B:
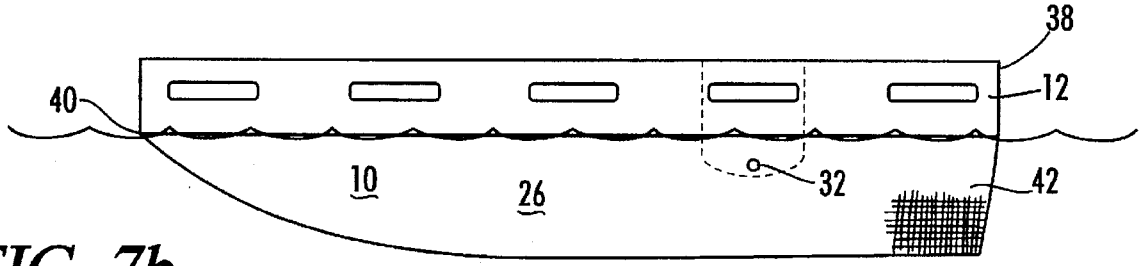

Referring now to FIGS. 7*a* and 7*b* there is shown generally at 26 sheet of the present invention in its preferred embodiment. When attached to frame 12, sheet 26 forms bottom 42 of device 10. In the preferred embodiment, sheet 26 is cut generally in the shape of a tombstone being wide proximal open end 38 and narrowing to point proximal closed end 40. Tabs or straps 28 are either cut from material while sheet 26 is cut or tabs 28 are fastened to sheet 26. Tabs 28 correspond to slots 30 in frame 12. Tabs 28 are received by slots 30 and attach back to themselves using snaps 32. Snaps have male portion 32*a* and female portion 32*b*. In place of snaps 32, any releasible attachment method such as hook and loop fabric can be used. When sheet 26 forms bottom 42, bottom is deep proximal open end 38 and shallow as it approaches a point proximal closed end 40.

Thus, although there have been described particular embodiments of the present invention of a new and useful device for protecting the hull of a water vehicle, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for protecting the hull of a water vehicle comprising:

a. a frame having an opened end and a closed end, said opened end receiving said water vehicle, said frame having a right yoke and a left yoke releasibly attached by a pin proximal said closed end;

b. a sheet attached to said frame, said sheet receiving said hull; and c. means for anchoring said device attached proximal said closed end.

2. The device of claim 1 further comprising an extender.

3. The device of claim 1 further comprising means for distancing said right yoke from said left yoke.

4. The device of claim 1 further comprising an extender for distancing said right yoke from said left yoke.

5. The device of claim 1 further comprising a tongue attached proximal said closed end.

6. A device for protecting the hull of a water vehicle comprising:

a. a frame having an opened end and a closed end, said frame having a right yoke and a left yoke releasably attached by a pin proximal said closed end, said opened end receiving said water vehicle, said frame having slots;

b. a sheet having tabs attached to said slots in said frame using snaps, said sheet receiving said hull; and c. means for anchoring said device attached proximal said closed end.

7. The device of claim 6 further comprising means for widening said frame.

8. The device of claim 6 further comprising an extender.

* * * * *